US007641197B2

(12) United States Patent
Jackson

(10) Patent No.: US 7,641,197 B2
(45) Date of Patent: Jan. 5, 2010

(54) CASINO POKER TABLE GAME WITH CHOICE OF STUD HANDS

(75) Inventor: Kathleen Nylund Jackson, Scituate, MA (US)

(73) Assignee: IGT, Reno, NV (US)

( * ) Notice: Subject to any disclaimer, the term of this patent is extended or adjusted under 35 U.S.C. 154(b) by 80 days.

(21) Appl. No.: 11/219,471

(22) Filed: Sep. 2, 2005

(65) Prior Publication Data

US 2006/0267283 A1 Nov. 30, 2006

Related U.S. Application Data

(60) Provisional application No. 60/684,441, filed on May 25, 2005.

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS

| | | | | | |
|---|---|---|---|---|---|
| 5,042,818 | A | * | 8/1991 | Weingardt | 463/13 |
| 5,100,137 | A | | 3/1992 | Fulton | |
| 5,573,249 | A | * | 11/1996 | Johnson | 273/292 |
| 5,669,817 | A | * | 9/1997 | Tarantino | 463/13 |
| 5,711,525 | A | | 1/1998 | Breeding | |
| 5,816,915 | A | * | 10/1998 | Kadlic | 463/13 |
| 5,823,873 | A | | 10/1998 | Moody | |
| 5,839,731 | A | | 11/1998 | Feola | |
| 6,007,066 | A | | 12/1999 | Moody | |
| 6,050,568 | A | | 4/2000 | Hachquet | |
| 6,098,985 | A | | 8/2000 | Moody | |
| 6,132,311 | A | | 10/2000 | Williams | |
| 6,135,882 | A | | 10/2000 | Kadlic | |
| 6,135,883 | A | | 10/2000 | Hachquet | |
| 6,146,271 | A | | 11/2000 | Kadlic | |
| 6,332,839 | B2 | | 8/2001 | Walker | |
| 6,334,613 | B1 | | 1/2002 | Yoseloff | |
| 6,358,144 | B1 | | 3/2002 | Kadlic | |
| 6,511,068 | B1 | | 1/2003 | Sklansky | |
| 6,517,074 | B1 | | 2/2003 | Moody | |
| 6,561,898 | B2 | | 5/2003 | Moody | |

(Continued)

*Primary Examiner*—Benjamin H Layno
(74) *Attorney, Agent, or Firm*—K&L Gates LLP

(57) ABSTRACT

A player places an ante wager to participate in the play of the underlying card game. An initial deal of at least one communal partial hand of poker consisting of at least one card is dealt from a single (or multiple) standard deck(s) of cards, standard deck(s) of cards with certain cards removed, or standard deck(s) of cards that is augmented by wild cards or jokers, especially with a partial communal hand consisting of two face-up cards. The player is directed to consider the partial hand and is then directed to choose to play the partial hand as either a 5-card stud game, a 6-card stud game, or a 7-card stud game by placing an additional Play wager on a particular Play Bet circle (i.e., the 5-card game, the 6-card game or the 7-card stud game. Three additional community cards are then dealt face up to complete the 5-card stud hand, and subsequently a $4^{th}$ and $5^{th}$ community card. Each wagered hand would then be compared to a predetermined pay table (for the specific game play selected by the player) and winnings would be awarded for certain predetermined combinations or ranks.

24 Claims, 9 Drawing Sheets

| 5-CARD STUD | | 6-CARD STUD | | 7-CARD STUD | |
|---|---|---|---|---|---|
| Royal Flush | 1000 | Royal Flush | 500 | Royal Flush | 200 |
| Straight Flush | 100 | Straight Flush | 40 | Straight Flush | 20 |
| 4-of-a-Kind | 60 | 4-of-a-Kind | 25 | 4-of-a-Kind | 15 |
| Full House | 10 | Full House | 6 | Full House | 4 |
| Flush | 7 | Flush | 5 | Flush | 3 |
| Straight | 5 | Straight | 3 | Straight | 2 |
| 3-of-a-Kind | 3 | 3-of-a-Kind | 2 | 3-of-a-Kind | 1 |
| Two Pair | 2 | Two Pair | 1 | Two Pair (Js High) | 1 |
| Jacks or Better | 1 | Aces or Better | 1 | | |

U.S. PATENT DOCUMENTS

| | | | |
|---|---|---|---|
| 6,569,014 | B2 | 5/2003 | Walker |
| 2003/0069055 | A1 | 4/2003 | Moody |
| 2003/0119572 | A1 | 6/2003 | Moody |
| 2003/0162424 | A1 | 8/2003 | Berman |
| 2004/0113363 | A1 | 6/2004 | Moody |
| 2005/0040601 | A1 | 2/2005 | Yoseloff |

* cited by examiner

| 5-CARD STUD | |
|---|---|
| Royal Flush | 1000 |
| Straight Flush | 100 |
| 4-of-a-Kind | 60 |
| Full House | 10 |
| Flush | 7 |
| Straight | 5 |
| 3-of-a-Kind | 3 |
| Two Pair | 2 |
| Jacks or Better | 1 |

| 6-CARD STUD | |
|---|---|
| Royal Flush | 500 |
| Straight Flush | 40 |
| 4-of-a-Kind | 25 |
| Full House | 6 |
| Flush | 5 |
| Straight | 3 |
| 3-of-a-Kind | 2 |
| Two Pair | 1 |
| Aces or Better | 1 |

| 7-CARD STUD | |
|---|---|
| Royal Flush | 200 |
| Straight Flush | 20 |
| 4-of-a-Kind | 15 |
| Full House | 4 |
| Flush | 3 |
| Straight | 2 |
| 3-of-a-Kind | 1 |
| Two Pair (Js High) | 1 |

CASINO POKER TABLE GAME WITH CHOICE OF STUD HANDS

RELATED APPLICATION DATA

This Application claims priority from U.S. Provisional Patent Application No. 60/684,441, filed May 25, 2005, and having the Title MULTIPLE HAND POKER SYSTEM WITH CHOICE OF STUD GAMES.

BACKGROUND OF THE INVENTION

1. Field of the Invention

The present invention relates to a poker game suitable for use in casinos and other gaming establishments as a casino table card game. The invention further relates to casino table gaming wherein the player chooses to play an initial partial hand as either a 5-, 6-, or 7-card stud game.

2. Background of the Art

Games based upon variations of poker have attained enormous popularity as casino-type entertainment games, particularly in the last twenty years. The success of poker games in the gaming industry is partially based on the game's simplicity (i.e., there is widespread public knowledge of the game rules) and the fact that players feel more directly involved in exercising judgment in the play of the game.

Traditional poker as played in card rooms and casinos allow players to compete head to head against other players. The casino typically charges a fee or vigorish for the privilege to play at the table, and so is one of the rare wagering games in which the casino does not have a built-in percentage advantage per game.

Many new approaches to poker have been developed for casino table games that can be played on a blackjack-like table, in which the players compete against the house or against a paytable, and in which the house has an edge or percentage advantage. These poker variations now rival the popularity of blackjack in many venues. Let It Ride™ poker, one of the first variants to gain popularity, is a version of 5-card stud played against a paytable that requires a three-part bet, and allows the withdrawal of up to two parts of the total bet after viewing certain cards. The downside of the game for the player is that simple strategy rules determine whether the player should withdraw part of the wager, so there is a lack of involvement and risk-taking decisions that typify the casino poker player.

Caribbean Stud Poker™ is also a 5-card stud game, but is played against the dealer's qualified hand and a paytable. The dealer must have a specified minimum hand to qualify, so that there is consternation for the player who holds a premium hand and is not allowed to capitalize on it. An optional side bet can be placed to qualify for a progressive jackpot, but the high casino advantage on this wager may discourage the player.

Three Card Poker™ is actually two games in one. Both games are based on hands consisting of three cards and the player may bet on either one, both, and in different amounts. Play begins with a wager on ante. After the player views his three cards he may either raise by putting an equal bet on play or fold and lose the ante bet. If the player does raise then he goes against the dealer's hand. The dealer needs at least a queen high to qualify. The Pair Plus wager is a simple side bet in which the player gets the three cards and is paid according to their value. The dealer's hand is immaterial. There is no raising and no discarding. Dealer qualification can be problematic in this poker variation as in Caribbean Stud, and the Pair Plus wager in fact requires no skill of any kind and so does not excite the decision-making player.

Four Card Poker® is akin to Three Card Poker® games, but as the name signifies, four cards are used instead of three. Other key differences are that there is no dealer qualifying hand, and the player can raise up to three times his ante. The dealer gets one extra card to form his best hand. The object of the game is for the player to form a four-card poker hand higher than, or equal in rank to the dealer's hand. Players use their best four of five cards dealt against the dealer's best four of six cards. However, players may have the perception that the dealer always has the upper hand, since the dealer gets the additional card.

3-5-7 Poker™ is a simple poker-based game that is actually a three-games-in-one wherein the player bets on both 3-card and 5-card hands, and may also bet on a 7-card poker hand, with payoffs set by a standard pay table. Since the 7-card hand usually has the lowest house advantage, all three games should generally be played. Unfortunately for the player, a poor 3-card hand will more likely determine poor 5- and 7-card hands, so the player may have almost no positive anticipation and end up losing all three hands.

There is a need to address these cited shortcomings and to provide alternative games so that the player is offered a quick and compelling poker table game that does not require dealer qualification and allows the player a decision-making process that encourages the player to play at a comfortable risk level.

U.S. Pat. No. 6,569,014 (Walker) and U.S. Pat. No. 6,332,839 (Walker) each disclose a method for playing draw poker wherein an initial hand is dealt, the player selecting to hold certain cards and discard others, if any, replacing the discards with replacement cards, and determining a payout on the resultant hand based on a ranking of the final hand and the number of cards drawn.

U.S. Pat. No. 6,517,074 (Moody); U.S. Pat. No. 6,135,883 (Hachquet); U.S. Pat. No. 6,098,985 (Moody); U.S. Pat. No. 6,050,568 (Hachquet); U.S. Pat. No. 6,007,066 (Moody); and U.S. Pat. No. 5,823,873 (Moody) each disclose a method for playing multiple hands of draw poker wherein an initial hand of cards is dealt, the player selecting none, one or more of the cards to be held, replacing the discards with replacement cards, and evaluating the resultant hand or hands for winning combinations.

U.S. Pat. No. 6,561,898 (Moody) discloses a method wherein the player is provided with the opportunity to increase or decrease the wager on multiple stud hands after the partial hands are shown and before the final hands are completed. Each partial hand contains the same cards, and the player does not choose a particular partial hand.

U.S. Pat. No. 6,511,068 (Sklansky) teaches a method of concurrent multiple communal card poker games wherein the player selects an initial partial hand which is then added to each of a plurality of communal-card flops, each communal-card flop corresponding to the number of poker games to be concurrently played. A plurality of remaining resulting poker hands are also derived, one for each combination of non-selected partial starting hands and each of the communal-cards flops.

The participant's resulting poker hands are compared to the remaining resulting poker hands to determine any winning hands.

U.S. Pat. No. 6,358,144 (Kadlic) and U.S. Pat. No. 6,146,271 (Kadlic) teach a method of providing multiple hands of poker, each being dealt with two cards face up and three cards face down. The player chooses an initial partial hand, which is then duplicated into each of the other hands. The remaining face-down cards in each hand are then revealed, and the player may then discard and draw replacement cards to final hands.

U.S. Pat. No. 6,334,613 (Yoseloff) discloses a method which provides a partial hand which can be played as at least two distinctive games of poker, the nature of the at least two games requiring decisions to be made where a decision with regard to an election of play strategy in one poker game that is intended to have or assist in getting a positive outcome is likely to have a negative effect or comprises an adverse strategy in the play of the second game.

U.S. Pat. No. 6,135,882 (Kadlic) teaches a method of providing multiple hands of poker, each being dealt with two cards face up and three cards face down. The player chooses an initial partial hand, the remaining face down cards in that hand are then revealed, and the player may then discard and draw replacement cards in that hand to provide for a final hand.

U.S. Pat. No. 6,132,311 (Williams) discloses a multiple play method wherein two cards are dealt face up and are the community cards that are common to each hand. The remaining three cards for each hand are dealt face down. The player may discard none, one or both of the face up community cards and receives replacement cards for the discarded cards, if any. The player may double his wager before or after the draw step. The face down cards are revealed, and final hands are evaluated for pays.

U.S. Pat. No. 5,839,731 (Feola) discloses a casino game based on a selected card game in which a player wagers on one or more of a group of hands, and where the chances of winning are not enhanced by the skills of the player and no discretion in the selection of cards is vested in either the player or dealer. A number of stud poker hands are dealt as lines on a playing surface and players wager as to which hand will win. Winning wagers are paid a multiple of the wager, or optionally, the multiple is based on the odds of obtaining the particular winning combination.

U.S. Pat. No. 5,711,525 (Breeding) teaches a method of playing a wagering game with built in probability variations wherein the player makes an initial bet to participate in a base game. Prior to the play of the game, the dealer displays at least one additional card from the deck. After viewing this card or cards, the player is given the opportunity to place an additional wager which would qualify the player for an additional winning.

U.S. Pat. No. 5,100,137 (Fulton) describes a method wherein an electronic, poker-type game provides a player with an opportunity to increase the amount wagered, and therefore to increase a winning payout, even after the player has received a definite indication that the player has won.

U.S. patent application No. 20050040601 (Yoseloff) discloses a multi-player automated casino table card game platform enabling the play of casino table poker-type games according to rules effected through a processor. Rules may include games similar to Let It Ride® stud poker such as playing a wagering game comprising a player placing a wager comprising at least two distinct parts and providing to the player at least a portion of the player's game elements so that partial information or a game outcome is provided; giving the player at least one opportunity, before the player's final game outcome is determined, to withdraw from engagement in the game at least one part of said at least two parts, but less than all of said at least two parts, and continuing play of the game with additional portions of the player's game elements being displayed to the player.

U.S. patent application No. 20040113363 (Moody) discloses a method of play wherein one of the player's wagers is allocated to a full hand of cards and the other wagers are allocated among poker hands that are comprised of various subsets of the full hand.

U.S. patent application No. 20030162424 (Berman) teaches a method of concurrent multiple communal card poker games wherein the player selects an initial partial hand which is then added to each of a plurality of communal-card flops, each communal-card flop corresponding to the number of poker games to be concurrently played. Each of the resulting poker hands for the participant is compared to a pay table to determine corresponding payouts.

U.S. patent application No. 20030119572 (Moody) teaches a method wherein a player makes a wager to play multiple hands of a stud poker game. A plurality of initial partial hands is displayed to the player. Each initial partial hand has the same cards with the cards displayed face up to the player. Each hand is then completed as a stud poker final hand. The player wins or loses depending on the poker hand ranking of each final hand. If the player achieves two or more final hands of the same poker hand ranking, the amount won by the player is increased, preferably as multiples of the original payout amounts.

U.S. patent application No. 20030069055 (Moody) teaches a method wherein one hand of four cards is dealt. The player selects cards from the first hand as cards to be held which are reused from the first hand into all of the other hands. Replacement cards for the non-selected cards are dealt into the first hand and an additional card is dealt so that the first hand has five cards. Additional cards are also dealt to all of the other hands so that each hand is a five card hand. The poker hand ranking of each hand is determined. The player is then paid for any winning poker hands based on a pay table and the amount of the player's wager.

It is an ever-increasing challenge to provide players with new and enticing game play features that will stimulate player interest and increase time at the table.

SUMMARY OF THE INVENTION

A player places an ante wager to participate in the play of the underlying table card game described herein. The size of the wager may vary dependent upon the house rules. The dealer deals an initial communal deal of one partial hand of poker of at least one card, but preferably two cards, that is dealt face up from a standard deck of cards, a standard deck of cards with certain cards removed, or a standard deck of cards that is augmented by wild cards or jokers. The player reviews the partial hand, and is directed to either fold (losing the ante wager) or play. A play decision requires an additional wager, preferably a sum equal to the ante wager. If the player folds, the ante wager is forfeited. If the player plays, the player is directed to choose to play the hand as either a 5-card stud game, a 6-card stud game, or a 7-card stud game. The additional wager is placed on the table felt in areas indicating a wager on either the 5, 6, or 7 card hand. After each player either folds or bets the additional wager to play, the dealer deals additional community cards face up, preferably three cards. In the preferred method, the community cards now number five (i.e., the total of the two initial cards and the additional three cards). The dealer may then place a marker to indicate whether the 5-card hand is a win, according to a predetermined paytable. The dealer then deals out a sixth card, again preferably placing a marker to indicate whether the 6-card hand is a win according to a separate paytable. The dealer then deals out a seventh card, again preferably placing a marker to indicate whether the 7-card hand is a win according to another separate paytable. The pay tables for the different stud games (i.e., 5-, 6- or 7-card stud games) will likely differ by decrementing the pay tables as the number of cards in the stud hand increases, and/or increasing the minimum rank required for an award as the number of cards in the stud hand increases, although a uniform pay table for all hands may be provided to 'level' apparent payouts and make selection of higher numbers of cards more attractive. The dealer then resolves each player's wager by either removing losing ante/play wagers or paying a winning hand according to the predetermined paytables.

A variation of the above gameplay may include dealing a different initial partial hand to each player instead of one communal initial partial hand. A separate variation may include dealing more than one communal partial hand, and allowing each player to choose which partial hand to play.

DETAILED DESCRIPTION OF THE INVENTION

Figure 1:
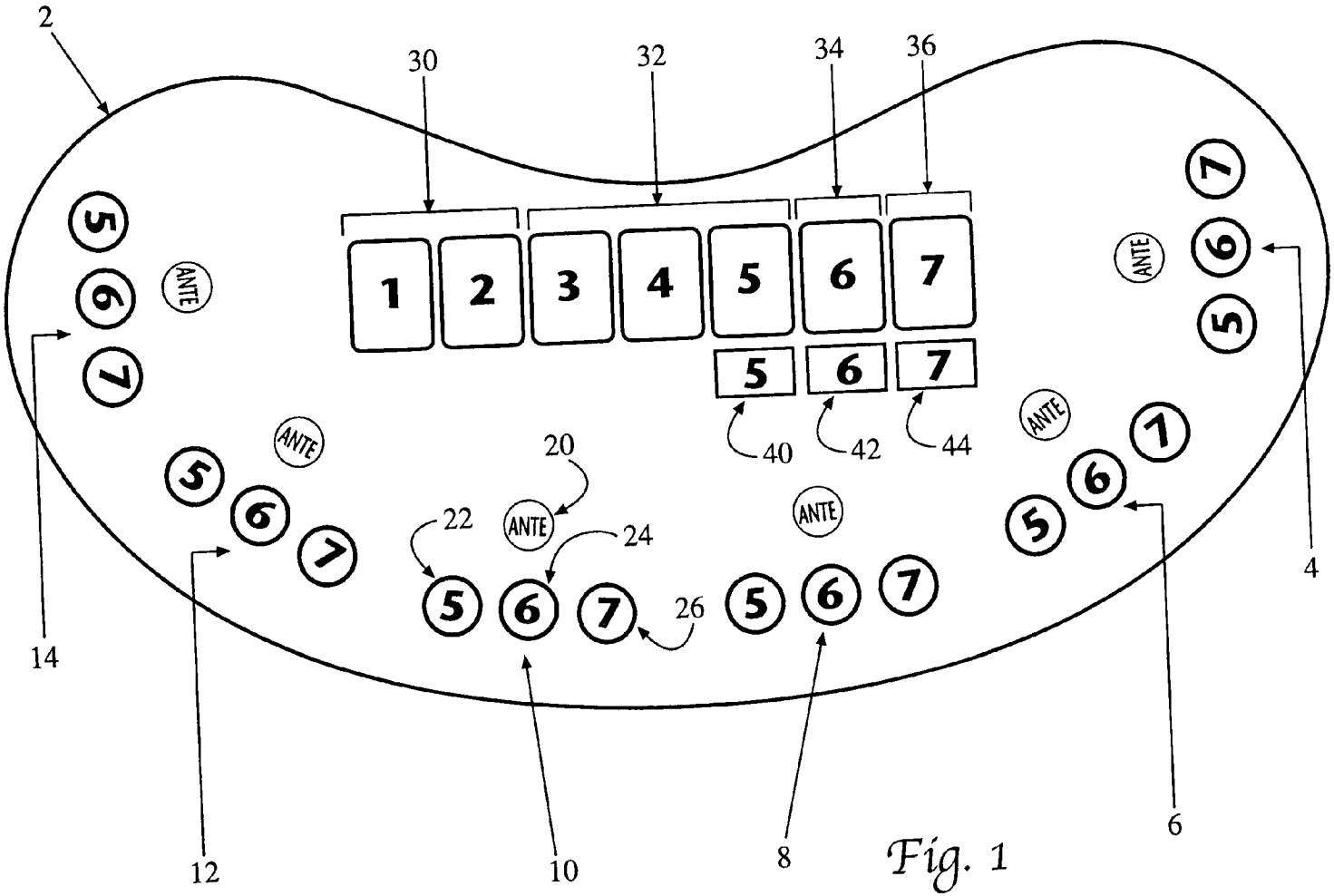
FIG. 1 shows a casino table game felt for the use of this invention.

The basic game of stud poker, with whatever number of cards is used as the final hand, is played by each hand (for each player or multiple hands to a single player) being dealt to a hand position and the rank of the hand is determined. In club or private games, the individual players play against each other and place wagers at each stage of the game (e.g., after the initial partial hand and then as each additional card or cards is provided to each player or as community cards). In a casino table card game or video card game environment, the final rank of each hand is compared to a paytable, and hands of predetermined ranks are paid according the rank attained and the amount of the wager on that particular hand.

The various types of stud games are primarily differentiated by the number of cards used in the hands (e.g., 2, 3, 4, 5, 6, and 7) and the number of cards used to establish a hand rank (usually 5 cards being a typical maximum number of cards to actually define a hand in play). For example, 5-card stud, 6-card stud and 7-card stud each form hands of five cards to determine the rank in the game.

The games according to the present disclosure may be provided as a live or hybrid casino table game. By hybrid systems is meant those systems known in the art where there may be a fully automated gaming table, such as the Shuffle Master, Inc. Multi-Player Platform™ system or a system with a dealer and automated bet recognitions and card reading and/or display. The wager may be provided in a casino table card game with chips, tokens, money, credit or credit charge. The wager in a video game is usually made with credits or credit charges.

One stud poker game that is very popular is a stud hold 'em game, in which a partial hand is dealt to each player (e.g., two cards) and only the player receiving the partial hand sees that partial hand. Wagering progresses at various stages of play, and community cards are provided in full view of all players. The players win pots containing all previous antes and wagers with the highest final hand rank. In 7-card stud, the highest five card rank wins the hand.

Although these games are very popular, and the casinos provide poker rooms for their play, casinos make their profit on the games by taking a rake or percentage of wagers or absolute amounts from each round of play. This is not a system that is attractive to players, who feel that the house is taking money out of play. It has therefore been desirable to provide more games in which play is against a paytable where awards can be easily calculated and the house profit comes from statistical considerations in the structure of the game. This house profit is often referred to as the "hold" in gaming parlance.

It is desirable to construct alternative games of stud poker that offer more options and excitement to players. The following descriptions describes methods and apparatus of play that assists in these games.

A player places an ante wager to participate in the play of the underlying card game. An initial deal of at least one communal partial hand of poker consisting of at least one card is dealt from a single (or multiple) standard deck(s) of cards, standard deck(s) of cards with certain cards removed, or standard deck(s) of cards that is augmented by wild cards or jokers. The preferred method would utilize one standard deck of 52 cards, and would deal one partial communal hand consisting of two face-up cards. The player is directed to consider the partial hand and is then directed to choose to play the partial hand as either a 5-card stud game, a 6-card stud game, or a 7-card stud game by placing an additional Play wager on a particular Play Bet circle (i.e., the 5-card game, the 6-card game or the 7-card stud game). If the player chooses to not wager the additional Play Bet, the player folds and the Ante bet is forfeited. Three additional community cards are then dealt face up to complete the 5-card stud hand. A marker may then be placed to indicate whether the 5-card hand is a winning or a losing hand according to a predetermined paytable. A fourth additional face-up community card is dealt, completing the 6-card hand. A separate marker may then be placed to indicate whether the 6-card hand is a winning or a losing hand according to a separate predetermined paytable. A fifth additional face-up community card is dealt, completing the 7-card hand. Another separate marker may then be placed to indicate whether the 7-card hand is a winning or a losing hand according to a separate predetermined paytable. Each wagered hand would then be compared to a predetermined pay table (for the specific game play selected by the player) and winnings would be awarded for certain predetermined combinations or ranks. The pay tables for the different stud games (i.e., 5-, 6- or 7-card stud games) will likely differ by decrementing the pay tables as the number of cards in the stud hand increases, and/or increasing the minimum rank required for an award as the number of cards in the stud hand increases, although a uniform pay table for all hands may be provided to 'level' apparent payouts and make selection of higher numbers of cards more attractive. This method may be used with various poker game variations such as Jacks or Better, Bonus Poker Games, or Wild Card Games.

A sample of paytables for the different games is provided below as examples, but not as limitations in the practice of the game.

Three Distinct Paytables for 5-Card Stud, 6-Card Stud and 7-Card Stud

5-Card Stud Table

| RANK | ODDS ON WAGER |
|---|---|
| PAIR OF JACKS OR BETTER | 1:1 |
| TWO PAIR FLUSH | 100:1 |
| ROYAL FLUSH | 1000:1 |

6-CARD Stud Table

| RANK | ODDS ON WAGER |
|---|---|
| PAIR OF ACES OR BETTER | 1:1 |
| TWO PAIR FLUSH | 40:1 |
| ROYAL FLUSH | 500:1 |

7-Card Stud Table

| RANK | ODDS ON WAGER |
|---|---|
| PAIR OF JACKS OR BETTER | 0 |
| TWO PAIR FLUSH | 20:1 |
| ROYAL FLUSH | 200:1 |

Reference to the Figures will assist in further understanding of the practice of the present invention.

FIG. 1 shows a casino table game felt 2 with six player positions 4, 6, 8, 10, 12, 14, each player position consisting of an Ante wagering circle 20 and three separate distinct wager circles for a 5-card hand wager 22, a 6-card hand wager 24 and a 7-card hand wager 26. A communal card area for a first and second card flop 30, a third, fourth and fifth card flop 32, a sixth card flop 34 and a seventh card flop 36 is shown. Also shown is an outcome area for the 5-card hand 40, an outcome area for the 6-card hand 42, and an outcome area for the 7-card hand 44.

Figure 2:
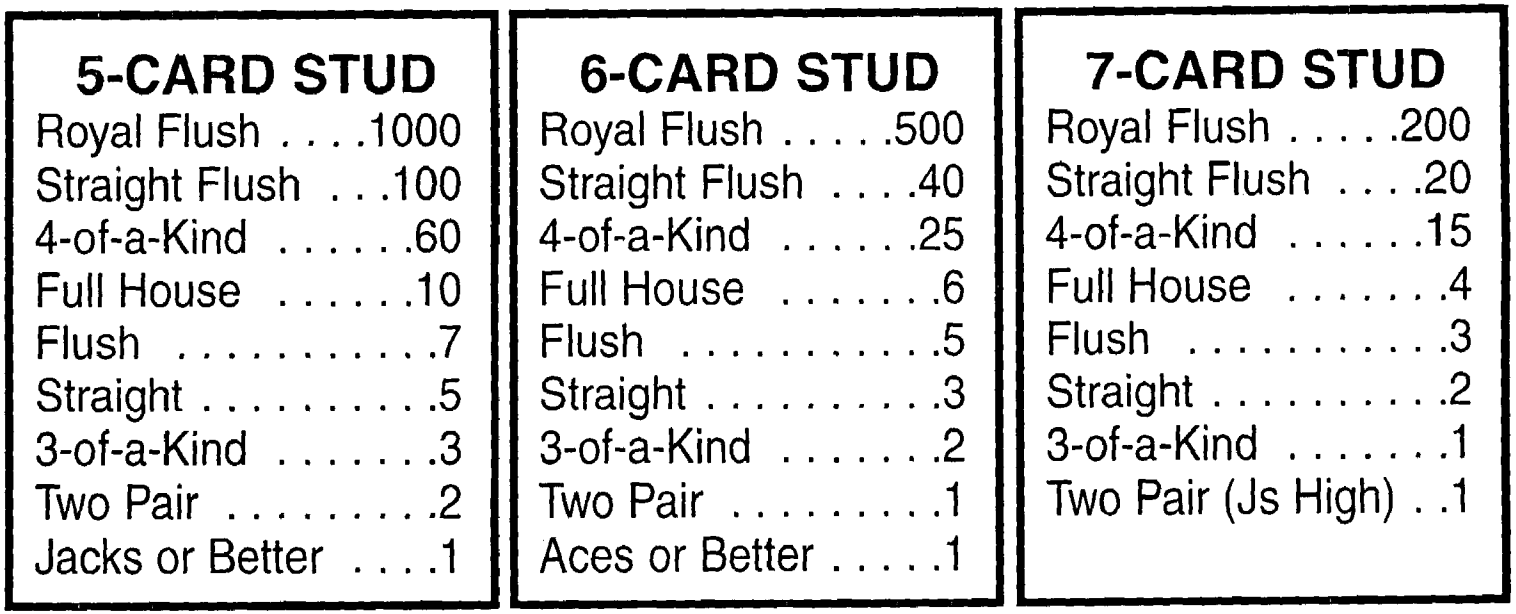
FIG. 2 shows a sample paytable for the use of this invention.

FIG. 2 shows a sample paytable 48, providing payouts for the 5-, 6-, and 7-card hands.

Figure 3:
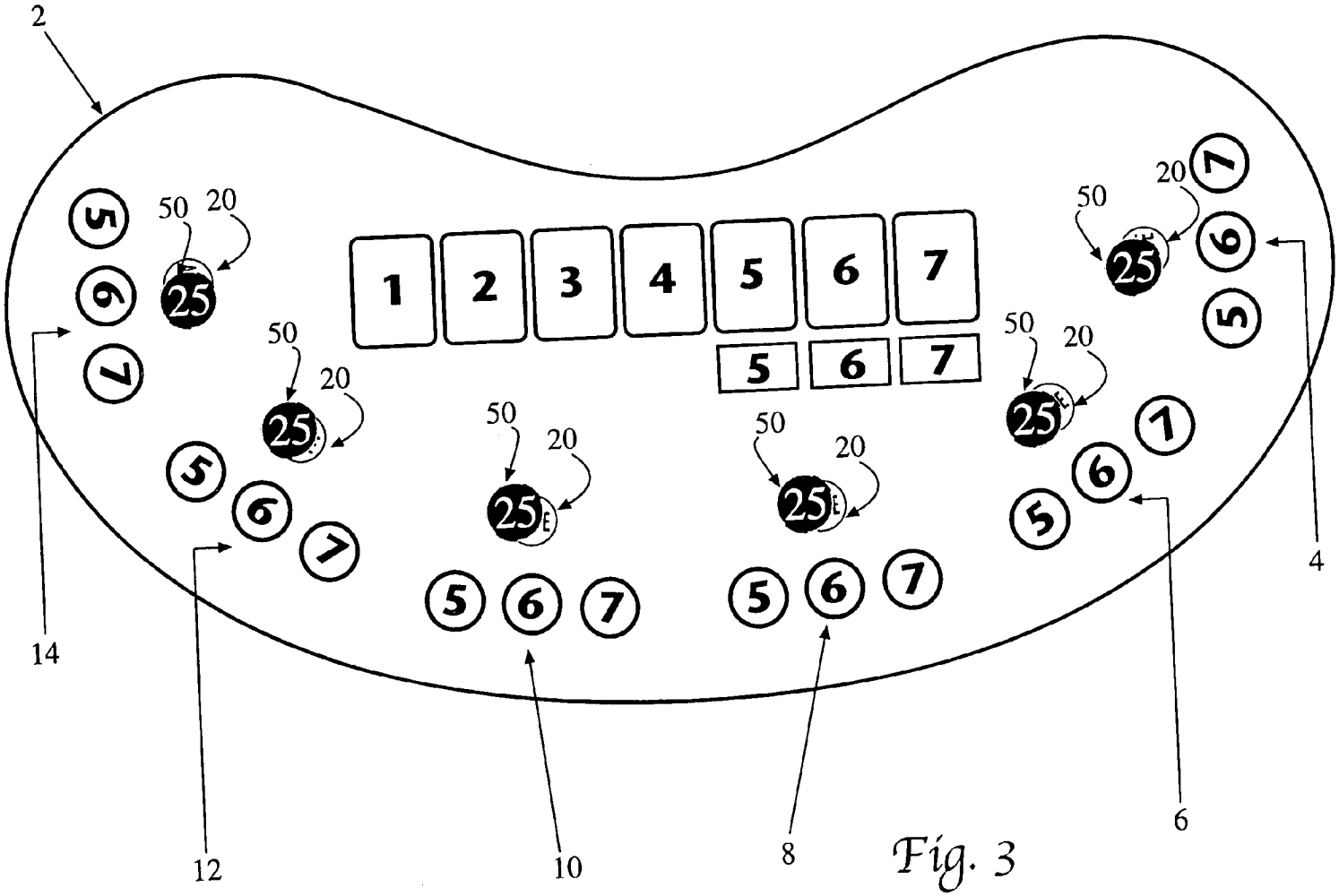
FIG. 3 shows each player placing a wager.

FIG. 3 shows the casino table game felt 2 with six player positions 4, 6, 8, 10, 12, 14, and a wager of $25 50 placed on Ante wagering circle 20 of each player position.

Figure 4:
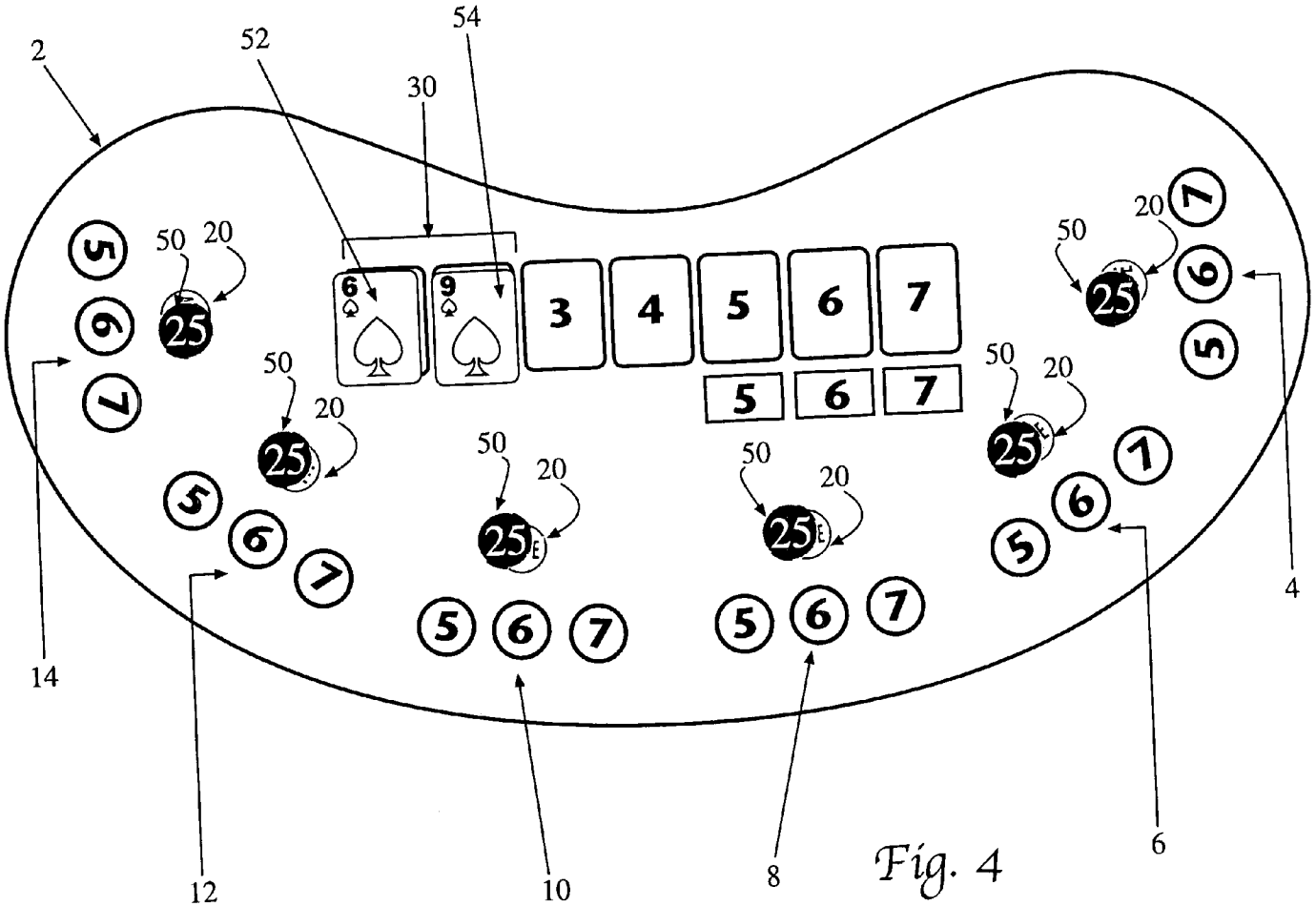
FIG. 4 shows the initial deal of one communal partial hand of two cards.

FIG. 4 shows the casino table game felt 2 of FIG. 3 with the flop of the first card 52 (the 6 of Spades) and the flop of the second card 54 (the 9 of Spades) on card area 30.

Figure 5:
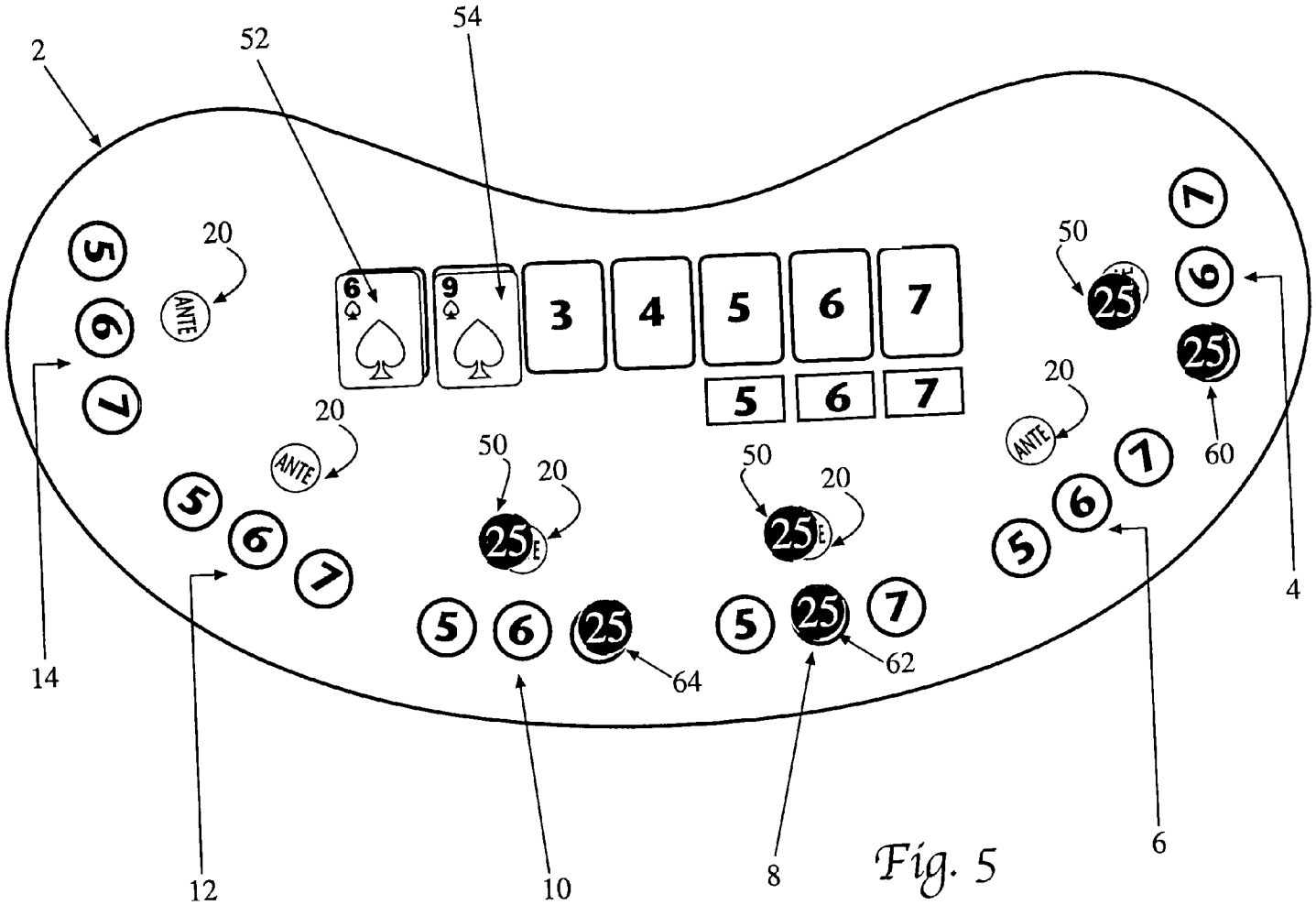
FIG. 5 shows each player either folding, or placing a Play bet on one of the three Play circles.

FIG. 5 shows the casino table game felt 2 of FIG. 4 with the play decision of each player. The first player position 4 shows a Play Bet on the 5-card hand 60. The second player position 6 shows an empty Ante circle 20, indicating the player Folds. The third player position 8 shows a Play Bet on the 6-card hand 62. The fourth player position 10 shows a Play Bet on the 7-card hand 64. The fifth player position 12 shows an empty Ante circle 20, indicating the player Folds. The sixth player position 14 shows an empty Ante circle 20, indicating the player Folds.

Figure 6:
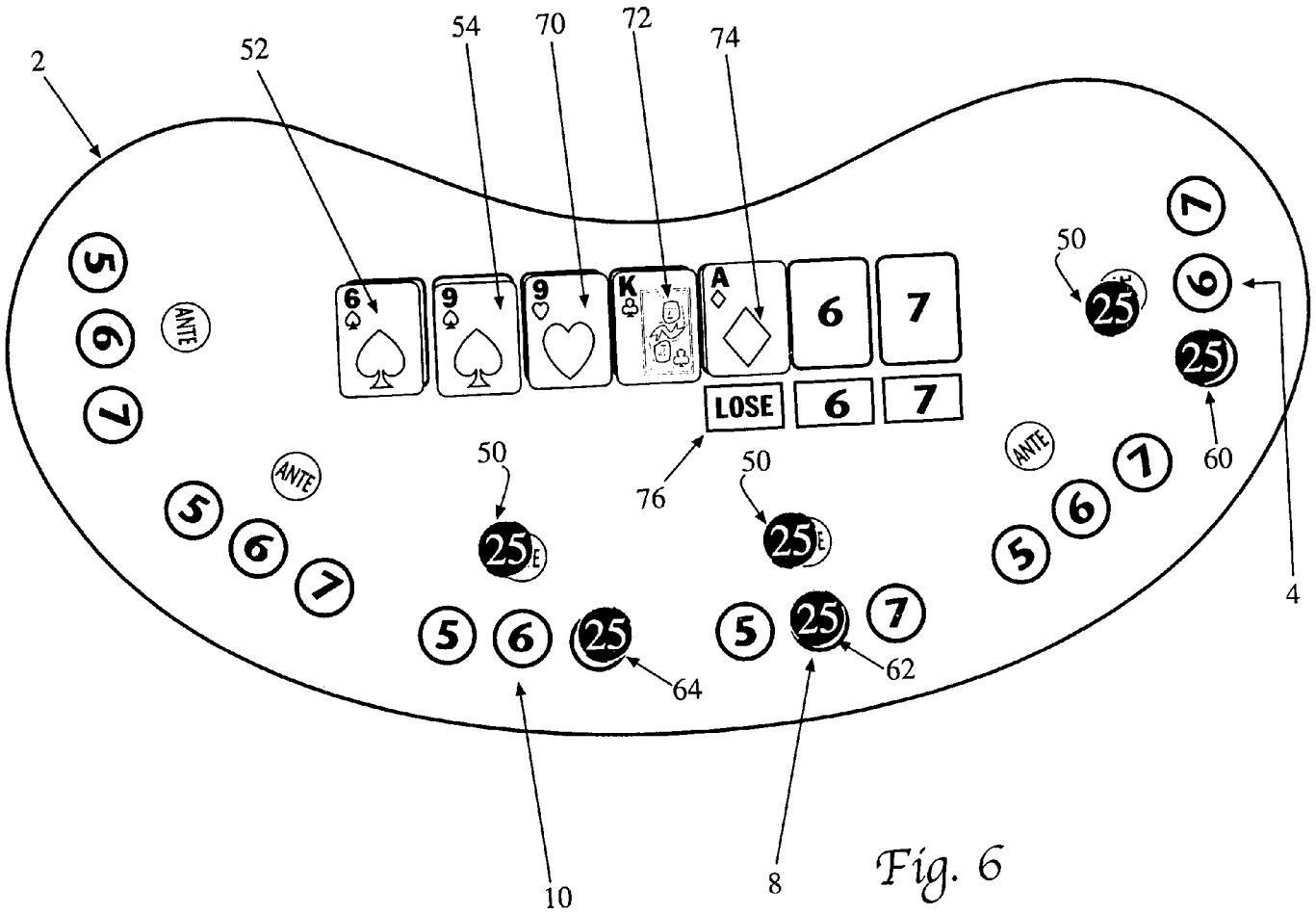
FIG. 6 shows the flop of three additional community cards, and a marker being placed on the 5-card hand dealer circle indicating a Loss on the 5-card hand.

FIG. 6 shows the casino table game felt 2 of FIG. 5 with the flop of the third card 70 (the 9 of Hearts), the fourth card 72 (the King of Clubs) and the flop of the fifth card 74 (the Ace of Diamonds). Since there is no win according to the sample paytable 48 in FIG. 2, a LOSE marker 76 is shown placed over the outcome area for the 5-card hand.

Figure 7:
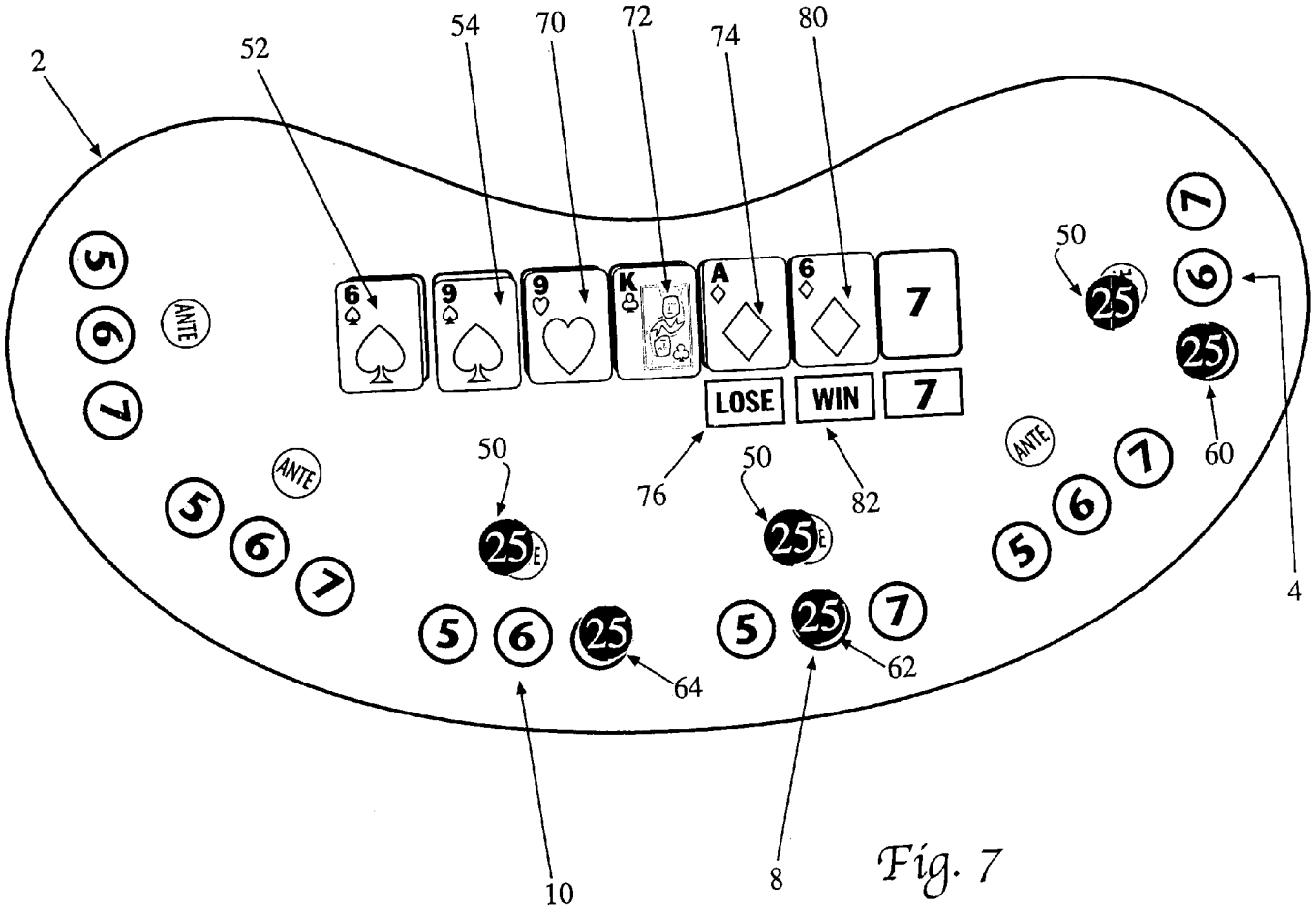
FIG. 7 shows the flop of one additional community card, and a marker being placed on the 6-card hand dealer circle indicating a Win on the 6-card hand.

FIG. 7 shows the casino table game felt 2 of FIG. 6 with the flop of the sixth card 80 (the 6 of Diamonds). Since there is a win of Two Pair according to the sample paytable 48 in FIG. 2, a WIN marker 82 is shown placed over the outcome area for the 6-card hand.

Figure 8:
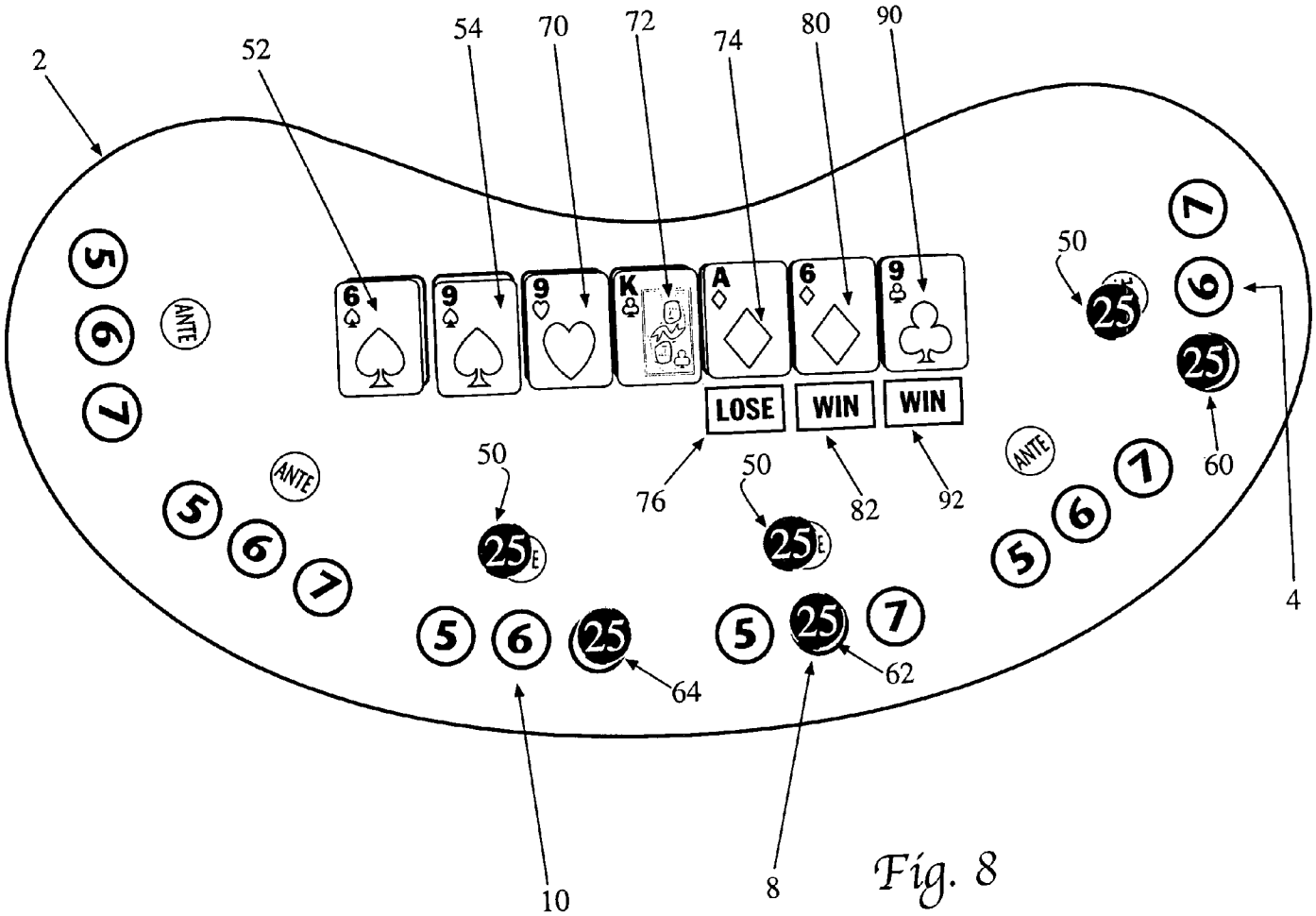
FIG. 8 shows the flop of a final additional community card, and a marker being placed on the 7-card hand dealer circle indicating a Win on the 7-card hand.

FIG. 8 shows the casino table game felt 2 of FIG. 7 with the flop of the seventh card 90 (the 9 of Clubs). Since there is a win of a Full House according to the sample paytable 48 in FIG. 2, a WIN marker 92 is shown placed over the outcome area for the 7-card hand.

Figure 9:
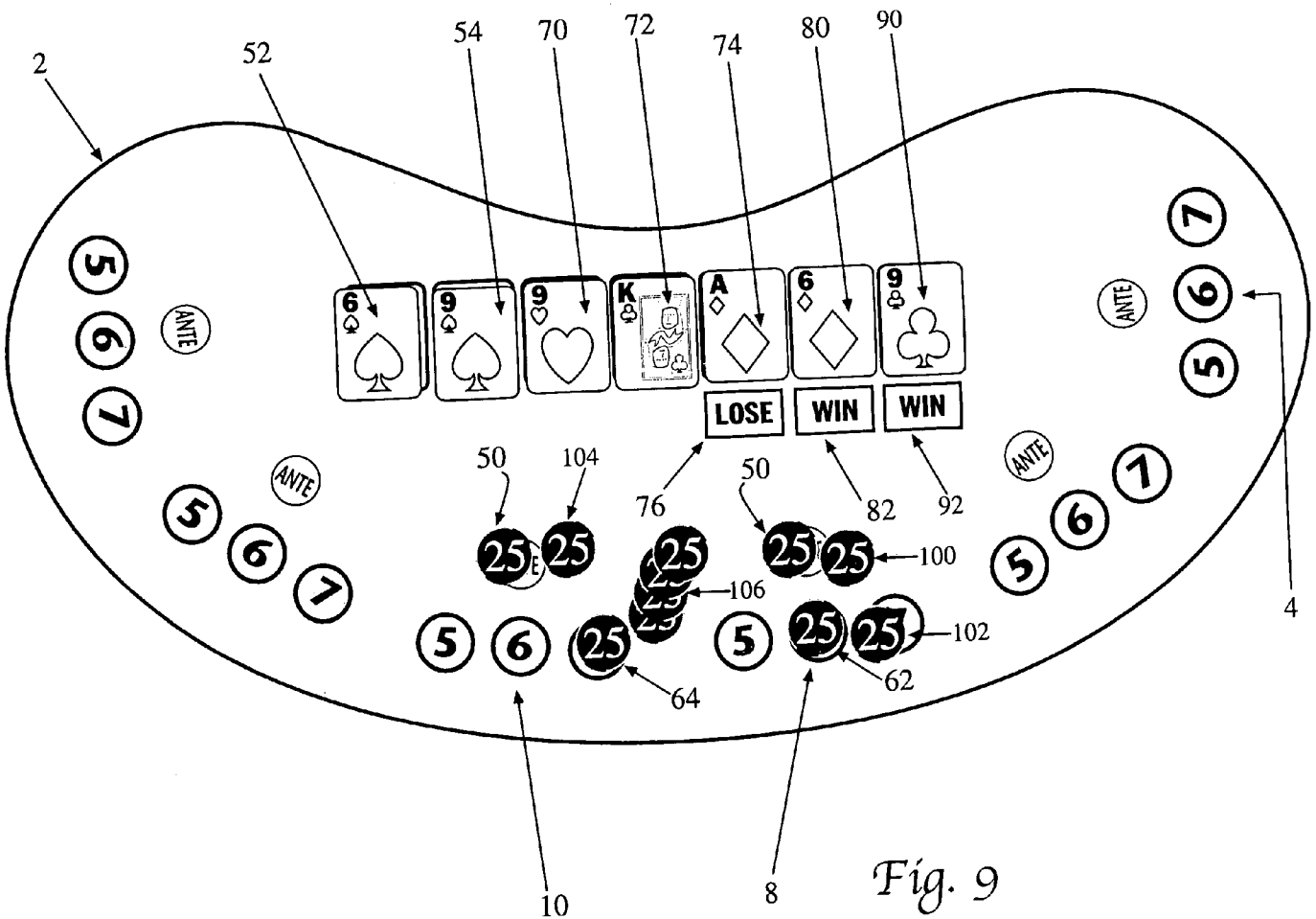
FIG. 9 shows the resolution of each player's wager.

FIG. 9 shows the casino table game felt 2 of FIG. 8 with the resolution of each active wager. The first player position 4 loses on the 5-card stud hand, with the Ante Bet and the 5-card hand wager shown removed. The third player position 8 wins the 1-to-1 Ante wager 50, the win of $25 100 is shown, and the Two Pair win 102 of the 6-card hand 62 is shown. The fourth player position 10 wins the 1-to-1 Ante wager 50, the win of $25 104 is shown, and the Full House win 106 of the 7-card hand 64 is shown.

Although specific examples and specific images have been provided in this discussion, these specifics are intended to be only support for the generic concepts of the invention and are not intended to be absolute limits in the scope of the technology discussed.

What is claimed:

1. A method of operating a single play of a wagering card game, said method comprising:

providing a set of playing cards;

enabling a player to place an initial wager amount for the single play of the wagering card game prior to viewing any cards from the set of cards in said single play of the wagering card game;

dealing the player a partial hand from the set of cards after the placement of the initial wager amount;

subsequent to dealing the partial hand, enabling the player to select to operate the single wagering card game according to the rules of one of a 5-card game, a 6-card game and a 7-card game, wherein no additional wager amount is required to enable the player to select to operate the single wagering card game according to the rules of the selected one of the 5-card game, the 6-card game and the 7-card game;

dealing one or more of the cards to complete the partial hand according to the rules of the selected one of the 5-card game, the 6-card game and the 7-card game;

causing at least one display device to display to the player a paytable for the 5-card game, a paytable for the 6-card game and a paytable for the 7-card game, wherein each of the paytables are different; and resolving the initial wager amount against the displayed paytable associated with the game selected.

2. The method of claim 1, which includes enabling the player to place multiple initial wagers wager amounts to play multiple hands.

3. The method of claim 2, wherein at least two of the multiple hands are operated according to the rules of a different one of the 5-card game, the 6-card game and the 7-card game.

4. The method of claim 2, wherein at least two of the multiple hands are operated according to the rules of the same one of the 5-card game, the 6-card game and the 7-card game.

5. The method of claim 2, wherein all of the multiple hands are operated according to the rules of the same one of the 5-card game, the 6-card game and the 7-card game.

6. The method of claim 1, wherein each of said plurality of different paytables has a plurality of different odds associated with identical hands provided for the 5-card game, the 6-card game and the 7-card game.

7. The method of claim 1, wherein the single wagering card game is operated as a video game with a display device.

8. The method of claim 1, wherein the single wagering card game is operated as a casino table game.

9. The method of claim 8, wherein a live dealer delivers the cards to one or more of said players.

10. The method of claim 1, which includes:

dealing the player a plurality of partial hands from the set of cards, and enabling the player to select one of the dealt partial hands to be operated in the single wagering card game.

11. The method of claim 10, wherein said cards dealt to complete the partial hand include cards that were not selected as the partial hand to be operated.

12. The method of claim 10, wherein the player elects whether said cards dealt to complete the partial hand include or do not include cards that were not selected as the partial hand to be operated.

13. The method of claim 12, wherein the election is made after the plurality of partial hands are viewed by the player.

14. The method of claim 12, wherein the election is made before the plurality of partial hands are viewed by the player.

15. A gaming table comprising:

a support structure;

at least one display device supported by the support structure and controlled by at least one processor; and a table top supported by the support structure, said table top configured such that a wagering card game can be operated on the table top;

said at least one processor configured to operate with said at least one display device to:

(a) enable a player to place a designated wager amount on a single play of the wagering card game, wherein said designated wager amount enables the player to operate the single wagering card game as a five-card wagering card game, a six-card wagering card game or a seven-card wagering card game;

(b) display to the player at least one, but not all of, a plurality of playing cards from a set of cards to form a partial hand of playing cards;

(c) subsequently to dealing the partial hand of playing cards, enable the player to select to operate the single wagering card game according to the rules of one of the five-card wagering card game, the six-card wagering card game and the seven-card wagering card game, wherein subsequent to displaying the partial hand of playing cards, no additional wager is required to enable the player to select to operate the single wagering card game according to the rules of the selected one of the five-card wagering card game, the six-card wagering card game or the seven-card wagering card game;

(d) display to the player a first paytable, a second paytable, and a third paytable, wherein each of the paytables are different;

(e) if the player selected to operate the single wagering card game according to the rules of the five-card wagering card game:

(i) display to the player at least one of the playing cards to form a complete, five-card hand of playing cards, and (ii) provide the player any payout according to the displayed first paytable, wherein said displayed first paytable is associated with the five-card wagering card game;

(f) if the player selected to operate the single wagering card game according to the rules of the six-card wagering card game:

(i) display to the player a plurality of the playing cards to form a complete, six-card hand of playing cards, and (ii) provide the player any payout according to the displayed second paytable, wherein said displayed second paytable is associated with the six-card wagering card game; and (g) if the player selected to operate the single wagering card game according to the rules of the seven-card wagering card game:

(i) display to the player a plurality of the playing cards to form a complete, seven-card hand of playing cards, and (ii) provide the player any payout according to the displayed third paytable, wherein said displayed third paytable is associated with the seven-card wagering card game.

16. The gaming table of claim 15, wherein said at least one processor is configured to operate with said at least one display device to display to the player a plurality of partial hands of playing cards and enable the player to select one of the displayed partial hands of playing cards to be played in the single wagering card game.

17. The gaming table of claim 15, wherein said at least one processor is configured to enable a plurality of players to each place the designated wager amount on a separate play of the single wagering card game.

18. The gaming table of claim 17, wherein said at least one processor is configured to operate with said at least one display device to display the formed partial hand of playing cards to each of the players.

19. The gaming table of claim 15, wherein the plurality of playing cards includes at least one wild playing card.

20. A method of operating a gaming system, said method comprising:

(a) providing a set of playing cards; and enabling a player to place a designated wager amount on a single play of a wagering card game, wherein said designated wager amount enables the player to operate the wagering card game as a five-card wagering card game, a six-card wagering card game or a seven-card wagering card game;

(b) dealing the player at least one, but not all of, a plurality of playing cards from the set of cards to form a partial hand of playing cards;

(c) subsequent to dealing the partial hand of cards, enabling the player to select to operate the single wagering card game according to the rules of one of the five-card wagering card game, the six-card wagering card game and the seven-card wagering card game, wherein subsequent to displaying the partial hand of playing cards, no additional wager is required to enable the player to select to operate the single wagering card game according to the rules of the selected one of the five-card wagering card game, the six-card wagering card game or the seven-card wagering card game;

(d) causing at least one display device to display to the player a first paytable, a second paytable, and a third paytable, wherein each of the paytables are different;

(e) if the player selected to operate the single wagering card game according to the rules of the five-card wagering card game:

(i) dealing the player at least one of the playing cards to form a complete, five-card hand of playing cards, and (ii) providing the player any payout according to the displayed first paytable, wherein said displayed first paytable is associated with the five-card wagering card game;

(f) if the player selected to operate the single wagering card game according to the rules of the six-card wagering card game:

(i) dealing the player a plurality of the playing cards to form a complete, six-card hand of playing cards, and (ii) providing the player any payout according to the displayed second paytable, wherein said displayed second paytable is associated with the six-card wagering card game; and (g) if the player selected to operate the single wagering card game according to the rules of the seven-card wagering card game:

(i) dealing the player a plurality of the playing cards to form a complete, seven-card hand of playing cards, and (ii) providing the player any payout according to the displayed third paytable, wherein said displayed third paytable is associated with the seven-card wagering card game.

21. The method of claim 20, which includes:

dealing the player a plurality of partial hands of playing card, and enabling the player to select one of the dealt partial hands of playing cards to be operated in the single wagering card game.

22. The method of claim 20, which includes enabling a plurality of players to each place the designated wager amount on a separate play of the single wagering card game.

23. The method of claim 22, which includes dealing the formed partial hand of playing cards to each of the players.

24. The method of claim 20, wherein the plurality of playing cards includes at least one wild playing card.

* * * * *

UNITED STATES PATENT AND TRADEMARK OFFICE

CERTIFICATE OF CORRECTION

PATENT NO. : 7,641,197 B2
APPLICATION NO. : 11/219471
DATED : January 5, 2010
INVENTOR(S) : Kathleen Nylund Jackson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 277 days.

Signed and Sealed this

Sixteenth Day of November, 2010

David J. Kappos

David J. Kappos
*Director of the United States Patent and Trademark Office*